United States Patent [19]

Klimczak

[11] Patent Number: 4,797,682

[45] Date of Patent: Jan. 10, 1989

[54] DETERMINISTIC THINNED APERTURE PHASED ANTENNA ARRAY

[75] Inventor: William N. Klimczak, Torrance, Calif.

[73] Assignee: Hughes Aircraft Company, Los Angeles, Calif.

[21] Appl. No.: 59,353

[22] Filed: Jun. 8, 1987

[51] Int. Cl.[4] ..... H01Q 21/00

[52] U.S. Cl. ..... 343/844; 343/770; 343/777; 343/853

[58] Field of Search ..... 343/844, 777, 770, 853

[56] References Cited

U.S. PATENT DOCUMENTS

| | | | |
|---|---|---|---|
| 3,553,706 | 7/1968 | Charlton | 343/777 |
| 3,811,129 | 5/1974 | Holst | 343/844 |
| 4,352,110 | 9/1982 | Braak | 343/844 |
| 4,617,573 | 10/1986 | Davidson | 343/844 |

OTHER PUBLICATIONS

Collins, Robert E. and Francis J. Zucker, *Antenna Theory,* Part 1, 1969, Chapter 6.

W. T. Patton, "Limited Scan Arrays," *Phased Array Antennas,* Ed. Oliner and Knittel, Polytechnic Institute of Brooklyn, pp. 332–343.

*Primary Examiner*—William L. Sikes

*Assistant Examiner*—Hoanganh Le

*Attorney, Agent, or Firm*—S. M. Mitchell; M. J. Meltzer; A. W. Karambelas

[57] ABSTRACT

A phased array antenna (10) includes a plurality of radiating elements (14) arranged in concentric rings (11, 12) to form a deterministically thinned antenna aperture which facilitates heat removal from the array, while minimizing side lobe signals and thereby increasing directively of the antenna for a preselected antanna gain. The radiating elements (14) in any one of the rings (11, 12) are the same radiating size, and the spacing (L, L') between elements in the same ring and between elements in adjacent rings (S, S') is determined by the number of elements in each ring. The rings may be any of several shapes, including circular or polygonal.

10 Claims, 3 Drawing Sheets

DETERMINISTIC THINNED APERTURE PHASED ANTENNA ARRAY

TECHNICAL FIELD

The present invention broadly relates to phased array antennas, especially of the type employing a so called thinned array of antenna elements. More particularly, the invention involves the process of predetermining a plurality of different sized radiating elements and predetermining their positions in the array such that the interelement spacing varies, thus utilizing fewer elements than would be employed in a conventional array, while maintaining the desired overall antenna gain. The use of fewer elements and unequal spacing decreases the cost of the array, facilitates thermal heat dissipation in active arrays, and minimizes the grating lobes.

BACKGROUND ART

In conventional periodic antenna arrays, the radiating elements are of uniform size and are equally spaced one-half wavelength apart, in order to minimize the effects of grating lobes. In practice, array elements cannot be located closer together than one-half wavelength because the closer spacing results in increased mutual coupling which changes the aperture illumination of the antenna. There are two primary disadvantages of periodic arrays. First, the cost of the array is proportional to the number of array elements and second, undesired coupling occurs between closely spaced elements. By varying the interelement spacing, fewer radiating elements are needed, thus decreasing the cost of the array and minimizing the coupling effects. Since the array occupies the same preselected "aperture", while utilizing fewer elements, it is said to be a "thinned" array.

Periodic antenna arrays may be of the "inactive" or "active" type wherein each radiating element in an active array is driven by a power amplifier. In the past, it has been necessary to thin the array in order to dissipate the thermal heat generated by the amplifiers in the array.

Conventional techniques of aperture thinning rely on statistical random exclusion of radiating elements to achieve the characteristics of the conventional periodic array. The statistically thinned elements are of uniform size and randomly located. However, they are not uniformly random across the aperture. The average density of the elements is statistically computed based on a model amplitude taper of the conventional periodic array. The model amplitude taper specifies the probability that an element will be located at a particular position in the aperture. In the thinned array, an element is placed at a particular location if the value of the amplitude taper, at that location, is less than a predetermined number.

Although statistical thinning reduces the effects of grating lobes, because the elements are randomly located, it can only be used with radiating elements of the same size. Furthermore, statistically thinned arrays are complicated to build because they are not uniformly designed.

The present deterministic thinned phase array is intended to overcome each of the deficiencies of prior art mentioned above.

SUMMARY OF THE INVENTION

The present invention is a deterministic thinned aperture phased array wherein fewer array elements are needed, to produce the same overall gain, than are needed in a conventional array or a statistically thinned array of the same aperture. The present invention is a circular aperture array arranged in rings of radiating elements, wherein the elements are unequally spaced. The element spacing is determined by the number and size of elements in the previous ring and in the ring itself.

Unlike previous aperture thinning techniques, the deterministic approach makes feasible the use of different size and more directive elements. In particular, since larger elements produce larger gains, a plurality of larger elements may be employed to reduce the number of overall elements needed to obtain a specific gain. However, the disadvantage of using larger elements in a conventional statistically thinned array is that they normally introduce grating lobes. Grating lobes are formed when the periodic spacing between elements is greater than one-half wavelength. In the present invention however, the grating lobe levels are minimized even though the interelement spacing may be larger than one-half wavelength. The grating lobes are minimized because, unlike conventional thinning techniques where the elements are arranged periodically, the present invention uses irregular element spacing and unequal element sizes to scatter the side lobe energy.

By employing a deterministic thinned aperture, fewer elements are used thus making it easier to dissipate thermal heat in active arrays, in which the radiating elements are driven by power amplifiers. In the past, the difficulty of removing the heat generated by each amplifier associated with each radiating element precluded the use of arrays in space borne applications, such as satellites.

It is therefore, a primary object of the invention to provide for aperture thinning by the use of a plurality of larger, more directive array elements of nonuniform size so that the total number of elements needed to achieve a specified gain requirement is minimized, thereby substantially reducing the cost of the array, reducing element coupling, and facilitating removal of thermal heat generated by each element amplifier.

Another object of the present invention is predetermining the nonperiodic position of the array elements so that the array may be efficiently designed and constructed.

A further object of the invention is to vary the element sizes so that the interelement spacing varies, thereby minimizing the effect of grating lobes and allowing for thermal heat dissipation between the elements.

Another object of the invention is predetermining the optimal thinning, element configuration, and array shape based upon the overall aperture requirements.

These and further objects and advantages of the invention will be made clear or will become apparent during the course of the following description of the invention.

DESCRIPTION OF THE PREFERRED EMBODIMENTS

Figure 1:
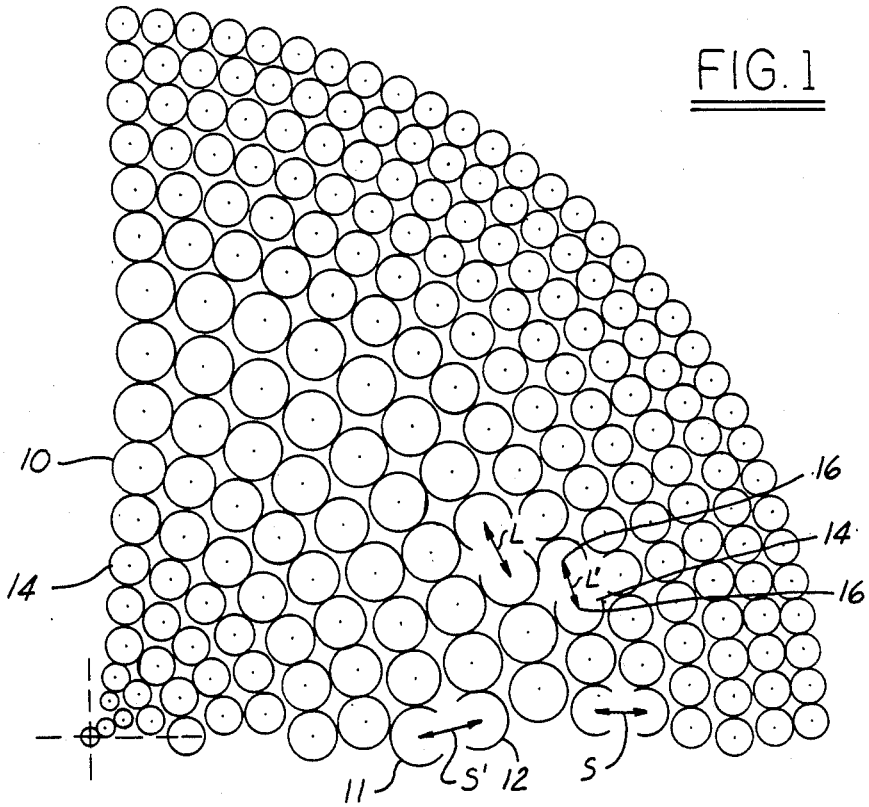
FIG. 1 is a front view of one quadrant of a deterministic thinned aperture phased array antenna, which is illustrative of the preferred embodiment of the present invention.

Referring to FIG. 1, one quadrant of a deterministic thinned circular aperture phase antenna array 10 is depicted, which includes a plurality of radiating elements 14 arranged in rows of rings 11, 12 wherein all of the radiating elements 14 in any particular ring, e.g. 11, 12 are of the same size e.g. diameter. However, the sizes of the elements 14 in adjacent rings 11, 12 are different; consequently, the distance L, L' between the centers 16 of adjacent elements 14 within a particular ring, in general, varies between the rings 11, 12. It can be readily appreciated that the spacing S, S' between the centers 16 of elements 14 in adjacent rings e.g. 11, 12 is a function of the sizes of the radiating elements in these rings. The spacing S, S' between adjacent rings 11, 12 and configuration of the radiating elements is determined by the operational frequency, band width, scan loss and gain requirements of the desired array 10. Based on the operational frequency requirements of the desired array 10, the ideal wavelength requirements of the radiating elements 14 is determined. The appropriate number of uniformly sized radiating elements can be estimated based upon the desired gain requirement of the overall antenna system, the scan loss requirements, and the radiating element wavelength requirements. Based on the number of uniformly sized radiating elements, the equivalent element gain can be determined. However, if radiating elements are employed which are larger than those used in a system employing uniformly sized elements, the larger elements will produce more gain. Hence, fewer radiating elements are needed to achieve the same overall gain. It is advantageous to use the fewest number of elements 14 possible in the array 10 since the cost of the array is proportional to the number of elements. Moreover, the more elements there are, the more complicated it is to build the array and, in connection with an active array, the more difficult it becomes to dissipate thermal heat.

Although the use of larger elements will decrease the number of overall elements needed in the array, the use of larger elements is normally disadvantageous because larger elements produce larger grating lobes because the periodic element spacing between the elements is larger than one-half of the wavelength. However, using deterministic thinning according to the present invention, the grating lobe levels are suppressed and minimized because elements 14 of unequal sizes are employed in the array 10. By varying the size of the radiating elements 14, the positions of the elements will not be periodic and the spacing S, S' between adjacent rings 11, 12, in general, will not be equal. Thus the grating lobes are minimized because they cannot accumulate in a periodic manner. The actual sizes of the radiating elements 14 employed are determined by conventional techniques. Both large and small elements are used so that the large elements compensate for the gain produced by small elements while maintaining the same overall gain as a system employing uniformly sized elements.

As previously discussed, the radiating elements 14 in each ring are the same size, while the radiating elements in different rings are, in general, different sizes. Similarly, the rings of radiating elements are positioned based upon the desired performance of the array. In FIG. 1, the array 10 is arranged to produce a deterministic thinned lens aperture array. One quadrant of the 845 element array is illustrated. The array consists of eighteen rings 11, 12 of radiating elements 14 wherein the element diameters range from 0.8 inches to 2.5 inches, as enumerated in Table I below.

TABLE I

| | 845 ELEMENT ARRAY | | |
|---|---|---|---|
| RING | NUMBER OF ELEMENTS IN RING | ELEMENT DIAMETER IN INCHES | DISTANCE FROM CENTER IN INCHES |
| 1 | 1 | .8 | 0.0 |
| 2 | 6 | .8 | .8 |
| 3 | 11 | .9 | 1.7 |
| 4 | 14 | 1.2 | 2.8 |
| 5 | 16 | 1.6 | 4.2 |
| 6 | 22 | 1.6 | 5.9 |
| 7 | 26 | 1.8 | 7.7 |
| 8 | 28 | 2.1 | 9.7 |
| 9 | 33 | 2.2 | 11.9 |
| 10 | 36 | 2.4 | 14.3 |
| 11 | 41 | 2.5 | 16.8 |
| 12 | 47 | 2.5 | 19.3 |
| 13 | 62 | 2.2 | 21.7 |
| 14 | 74 | 2.0 | 23.9 |
| 15 | 89 | 1.8 | 25.8 |
| 16 | 100 | 1.7 | 27.6 |
| 17 | 113 | 1.6 | 29.3 |
| 18 | 126 | 1.5 | 30.8 |

Table I lists the ring number, the number of elements per ring, the horn diameters and the distance of the ring from the array center.

Figure 2:
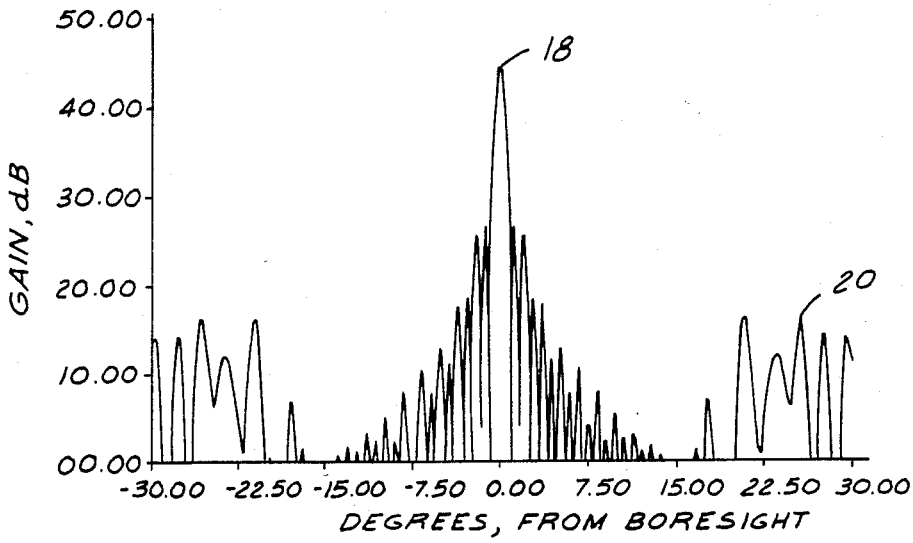
FIG. 2 is a plot of the uniform illumination scan for the array of FIG. 1, at 14.0 GHz in the $\Phi=90$ degree plane.

Referring to FIG. 2, the uniform illumination scan of the 845 element array at zero degrees, in the $\Phi=90$ degree plane, is illustrated. The peak gain 18 of the array is 45.27 dB. A peak gain 18 of 45.27 dB for an 845 element array represents an average element gain of 16.0 dB, calculated as follows:

$$\begin{aligned}\text{Average Element Gain} &= 45.27\text{ dB} - 10\log(845)\\ &= 45.27\text{ dB} - 29.27\text{ dB}\\ &= 16.0\text{ dB}\end{aligned}$$

This corresponds approximately a 2.2 wavelength dominant mode horn. Using an 845 element array of 2.2 wavelength diameter horns would produce a grating lobe 20 at approximately 27 degrees from boresight. As shown in FIG. 2, the level of the grating lobe 20 at 27 degrees is approximately 30 dB down from the peak gain 18 of the array.

Figure 3:
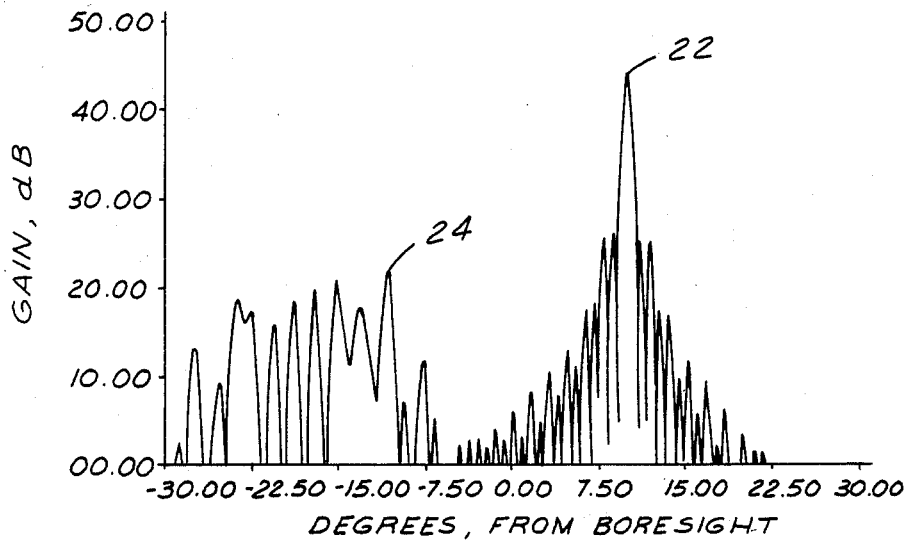
FIG. 3 is a plot of the uniform illumination scan for the array of FIG. 1, at 14.0 GHz in the $\Phi=90$ degree plane and scanned 10 degrees from boresight.

Referring to FIG. 3, the uniform illumination pattern, for an 845 element array, scanned to 10 degrees from boresight, for a pattern cut in the $\Phi=90$ degree plane, produces a peak gain 22 at 44.08 dB. When an array comprising 2.2 wavelength diameter elements is scanned to 10 degrees from boresight, a grating lobe 24 is produced at approximately 16.0 degrees from boresight and is approximately 20 dB down from the peak gain 22. Hence, the scan loss of an 845 element array, in the $\Phi=90$ degree plane is 1.19 dB, the difference between the peak gain 22 when the array is scanned 10 degrees from boresight and the peak gain 18 when it is not scanned.

Figure 4:
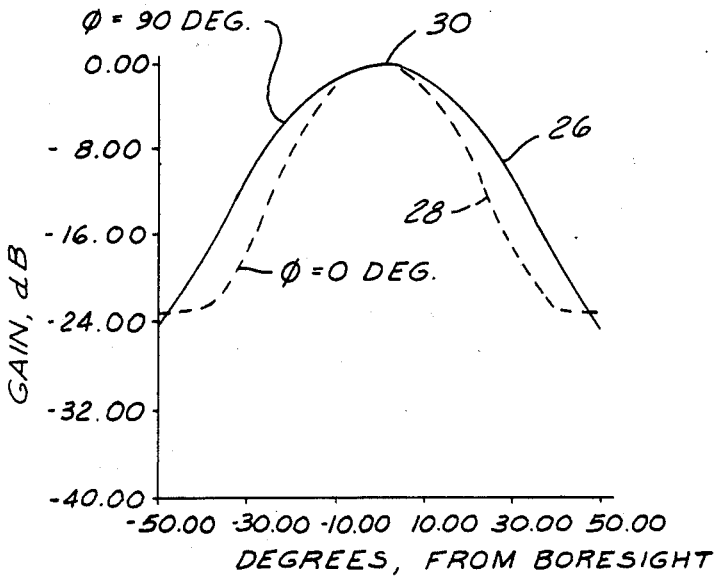
FIG. 4 is a plot of the radiation pattern of the array of FIG. 1 in the $\Phi=90$ degree and $\Phi=0$ degree plane at 14.0 GHz.
Figure 5:
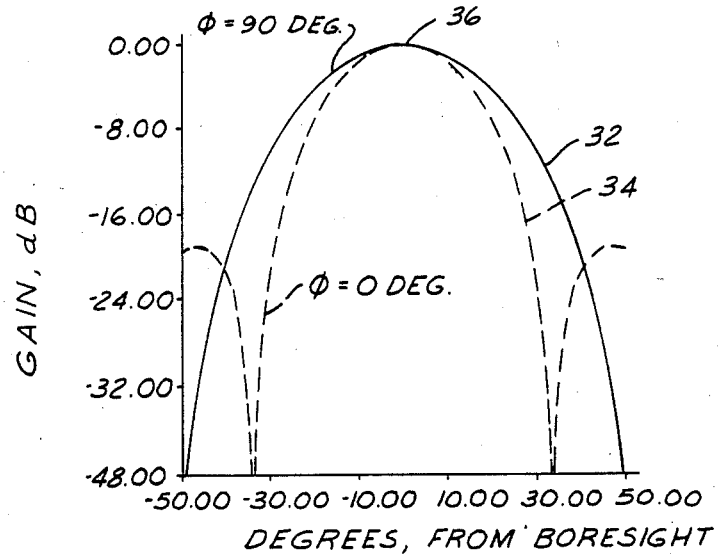
FIG. 5 illustrates the radiation pattern of a 2.2 wavelength diameter dominant mode, vertically polarized horn in the $\Phi=90$ degrees and $\Phi=0$ degrees plane.

Referring to FIGS. 4 and 5, concurrently, the scan loss characteristics 26, 28 of the 845 element array 10, are shown in FIG. 4 for a $\Phi=90$ degrees and $\Phi=0$ degrees, respectively. The peak gain 30 is 45.27 dB at boresight. The scan loss characteristic 26, 28 closely resemble the pattern cut of a 2.2 wavelength diameter horn, illustrated in FIG. 5, where curve 32 represents the $\Phi=90$ degree plane and curve 34 represents the $\Phi=0$ degree plane. Thus, the design of deterministic thinned lens aperture array 10 achieves similar scan loss as a 2.2 wavelength horn while taking on the advantageous gain characteristics of more directive elements, yet avoiding the disadvantageous grating lobe characteristics, produced by the larger element spacing.

Figure 6:
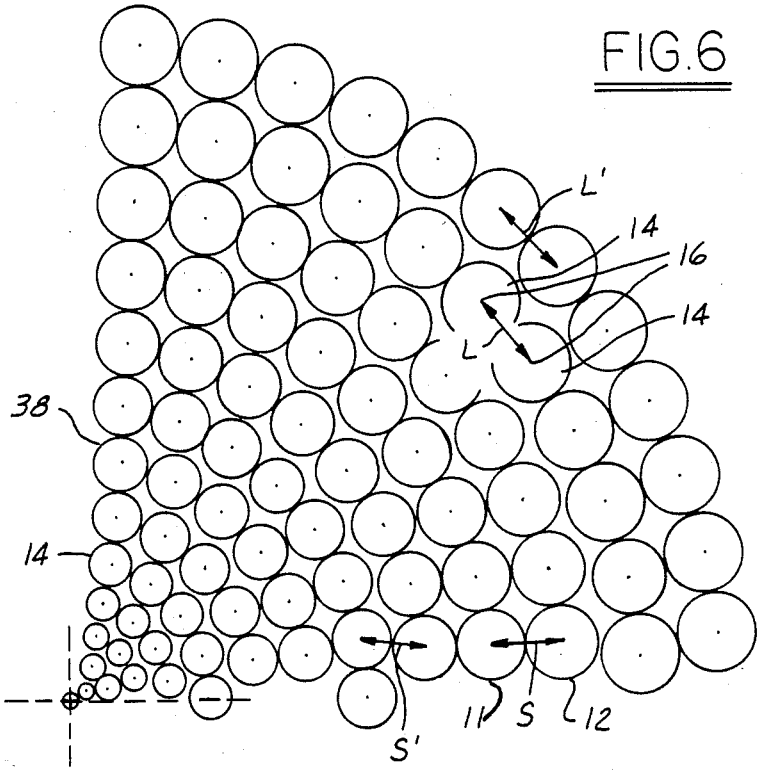
FIG. 6 is a front view of one quadrant of an alternate form of the deterministically thinned antenna array of the present invention.

As previously discussed, the deterministic thinning approach can be employed in various types of arrays to achieve a specific gain requirements. Referring to FIG. 6, another deterministic thinned array configuration is illustrated wherein one quadrant of a 366 element array 38 is shown. Unlike the array 10 illustrated in FIG. 1, the array elements 14 are arranged so that the smallest elements are in the center of the circular array 38 and the element diameters increase radially, such that the largest elements are on the outer perimeter of the circular array. Yet, the array 38 is similar to that depicted in FIG. 1 because nonuniformly sized elements 14 are used and the spacing S, S' between adjacent rings 11, 12, in general, varies.

In connection with the deterministic thinning technique of the present invention, the elements 14 in a particular ring, e.g. 11, 12 may be of varying size, and the array boundary need not be confined to a circular aperture: rings 11, 12 (and thus the boundary of the array) can be of virtually any shape (rectangular, square, circular, hexagonal).

What is claimed is:

1. An improved antenna array of the type having a thinned aperture defined by a plurality of radio frequency radiating elements operable over a preselected bandwidth and having a desired gain, said antenna array producing a main lobe signal and side lobe signals within said bandwidth, wherein the improvement comprises:

the radiating elements being arranged in at least first, second and third groups thereof concentrically disposed about a reference point, said first, second and third groups being respectively spaced at successively greater distances from said reference point with said second group positioned between said first and third groups, the radiating sizes of the elements in said first and third groups being smaller than those of the elements in said second group, whereby to increase the amplitude and directivity of said main lobe signal and minimize the amplitude of said side lobe signals relative to said main lobe signal.

2. The improved antenna array of claim 1, wherein the radiating elements in each of said groups are arranged into a plurality of concentric rings.

3. The improved antenna array of claim 1, wherein each of said radiating elements is essentially circular in shape.

4. The improved antenna array of claim 1, wherein the radiating elements in at least one group thereof are of a plurality of radiating sizes.

5. The improved antenna array of claim 1, wherein the radiating elements in each of said groups are of a pluralilty of radiating sizes.

6. The improved antenna array of claim 1, wherein the radiating elements in at least one of said groups are arranged in a plurality of concentric rings, with the radiating elements in each of said rings being essentially contiguous to each other.

7. The improved antenna array of claim 6, wherein each of said rings is circular in shape.

8. An improved antenna array of the type including a plurality of excitable radiating elements producing a main lobe signal having a desired gain and side lobe signals within the operating frequency of said antenna array, the improvement comprising:

the radiating elements being of differing radiating sizes and arranged concentrically around a reference point, the sizes of said radiating elements decreasing in magnitude with increasing radial distance from said reference point along at least a first portion of a radius emanating from said reference point.

9. The improved antenna array of claim 8, wherein the sizes of said radiating elements increase in magnitude with increasing radial distance from said reference point along a second portion of said radius disposed radially inward from said first portion.

10. The improved antenna array of claim 8, wherein said radiating elements are each circular in shape and are arranged into a plurality of nested rings.

* * * * *